US012467168B2

(12) United States Patent
Lee et al.

(10) Patent No.: US 12,467,168 B2
(45) Date of Patent: Nov. 11, 2025

(54) WARP KNIT COMPONENT WITH WEFT INLAYS

(71) Applicant: NIKE, Inc., Beaverton, OR (US)

(72) Inventors: Eun Kyung Lee, Beaverton, OR (US); Pomin Chang, Hemei Township (TW); Huihuang Huang, Hemei Township (TW)

(73) Assignee: NIKE, Inc., Beaverton, OR (US)

( * ) Notice: Subject to any disclaimer, the term of this patent is extended or adjusted under 35 U.S.C. 154(b) by 121 days.

(21) Appl. No.: 17/990,383

(22) Filed: Nov. 18, 2022

(65) Prior Publication Data

US 2023/0160114 A1 May 25, 2023

Related U.S. Application Data

(60) Provisional application No. 63/282,834, filed on Nov. 24, 2021.

(51) Int. Cl.

| | |
|---|---|
| ***D04B 21/06*** | (2006.01) |
| ***A43B 23/02*** | (2006.01) |
| ***D04B 21/14*** | (2006.01) |

(52) U.S. Cl.

CPC ..... *D04B 21/14* (2013.01); *D04B 21/06* (2013.01); *A43B 23/0245* (2013.01); *D10B 2501/043* (2013.01)

(58) Field of Classification Search

USPC ..... 66/192, 193

See application file for complete search history.

(56) References Cited

U.S. PATENT DOCUMENTS

| | | | | |
|---|---|---|---|---|
| 1,126,367 A * | 1/1915 | Bodensiek | A41C 1/00 | 450/118 |
| 2,022,751 A * | 12/1935 | Waksmundzka | A41B 9/02 | 450/104 |
| 4,036,037 A * | 7/1977 | Huckfeldt | D04B 21/205 | 66/190 |
| 4,122,555 A * | 10/1978 | Safrit | D04B 1/243 | 2/407 |

(Continued)

FOREIGN PATENT DOCUMENTS

| | | | |
|---|---|---|---|
| CN | 103518011 B | 2/2016 | |
| EP | 0273591 A1 * | 7/1988 | D04B 21/06 |

(Continued)

OTHER PUBLICATIONS

U.S. Appl. No. 62/958,493 (Year: 2020).*

(Continued)

*Primary Examiner* — Grace Huang

(74) *Attorney, Agent, or Firm* — Shook, Hardy & Bacon L.L.P.

(57) ABSTRACT

A warp knit component that includes a first front weft inlaid yarn that extends through one or more loops in a first warp knit course, and after extending through the one or more loops, the first front weft inlaid yarn extends as a float positioned on a technical face or front side of the warp knit component. After extending as the float, the first front weft inlaid yarn extends through one or more loops in a second warp knit course that is offset in the material flow direction from the first warp knit course. Using floats facilitates the advancement of the first front weft inlaid yarn in the material flow direction.

8 Claims, 7 Drawing Sheets

(56) References Cited

U.S. PATENT DOCUMENTS

| | | | | |
|---|---|---|---|---|
| 4,344,307 | A | 8/1982 | Bucher et al. | |
| 4,748,078 | A * | 5/1988 | Doi | D04B 21/08 66/169 A |
| 5,133,199 | A * | 7/1992 | Parikh | D04B 21/12 602/76 |
| 5,615,562 | A | 4/1997 | Roell | |
| 5,768,758 | A * | 6/1998 | Deignan | D03D 3/005 29/91.1 |
| 6,314,768 | B2 * | 11/2001 | Motoya | D04B 21/10 66/195 |
| 6,389,851 | B1 * | 5/2002 | Groshens | D04B 21/14 66/195 |
| 6,800,367 | B2 * | 10/2004 | Hanyon | D02G 3/442 428/394 |
| 9,226,540 | B2 * | 1/2016 | Podhajny | D04B 1/22 |
| 9,723,890 | B2 * | 8/2017 | Long | A43B 23/0295 |
| 9,889,267 | B2 * | 2/2018 | Wells | A61M 16/0683 |
| 10,745,834 | B2 * | 8/2020 | Terai | A43B 23/0235 |
| 10,753,019 | B2 * | 8/2020 | Berrian | A43B 23/042 |
| 10,947,650 | B2 * | 3/2021 | Wu | A43C 1/04 |
| 11,053,614 | B2 * | 7/2021 | Stewart | F16J 15/22 |
| 11,414,796 | B2 * | 8/2022 | Meir | A43B 1/04 |
| 11,572,642 | B2 * | 2/2023 | Line | D04B 1/24 |
| 2006/0112591 | A1 * | 6/2006 | Lombardo | A43B 13/36 36/15 |
| 2015/0233029 | A1 * | 8/2015 | Woodruff | D04B 21/14 66/13 |
| 2017/0121869 | A1 | 5/2017 | Cheng | |
| 2018/0103783 | A1 | 4/2018 | Danaher | |

FOREIGN PATENT DOCUMENTS

| | | | |
|---|---|---|---|
| EP | 3239376 | A1 | 11/2017 |
| GB | 822184 | A | 10/1959 |

OTHER PUBLICATIONS

International Search Report and Written Opinion received for PCT Patent Application No. PCT/US2022/050592, mailed on Mar. 21, 2023, 12 pages.

* cited by examiner

WARP KNIT COMPONENT WITH WEFT INLAYS

CROSS-REFERENCE TO RELATED APPLICATIONS AND PRIORITY CLAIM

This non-provisional patent application claims priority to co-pending U.S. provisional patent app. No. 63/282,834, filed on Nov. 24, 2021, and titled "Warp Knit Component with Weft Inlays," the entire contents of which is incorporated herein by reference.

TECHNICAL FIELD

Aspects herein relate to a warp knit component that may be used in, for example, an upper for an article of footwear where the warp knit component includes at least one front weft inlaid yarn that is floated over a technical face of the warp knit component to advance the direction of the front weft inlaid yarn in a material flow direction.

BACKGROUND

Traditional warp knit components may utilize weft inlaid yarns. However, in these traditional warp knit constructions, the weft inlaid yarn extends through a knit loop at every wale that the weft inlaid yarn crosses. As such, there is no ability to change the direction of the weft inlaid yarn in a material flow direction. Stated differently, traditional weft inlaid yarns uniformly extend orthogonal to a material flow direction.

BRIEF DESCRIPTION OF THE DRAWINGS

Examples of aspects described herein are discussed in detail below with reference to the attached drawing figures, wherein.

DETAILED DESCRIPTION

Figure 1:
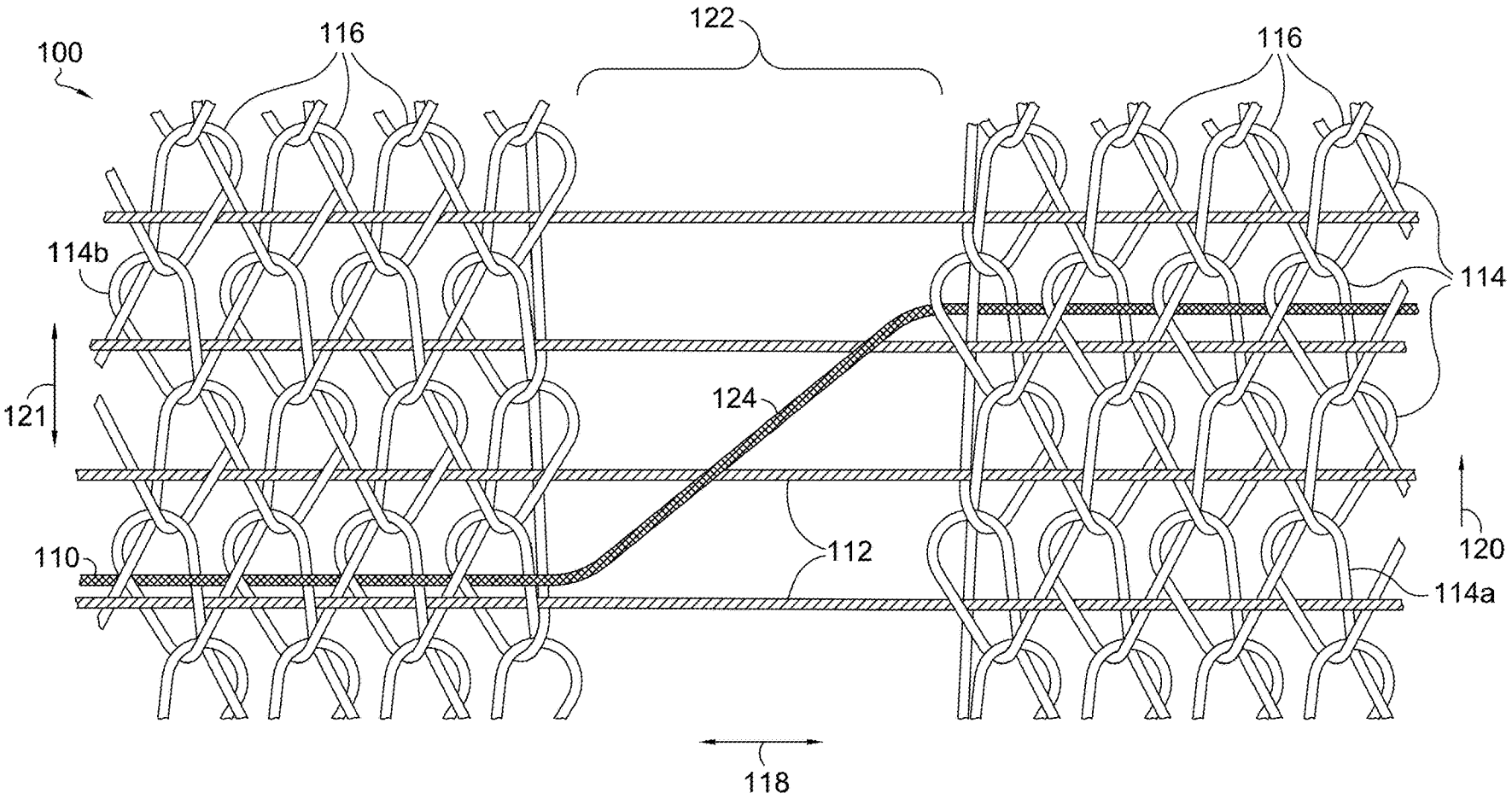
FIG. 1 depicts a schematic of a portion of a warp knit component having a first front weft inlaid yarn and a plurality of back weft inlaid yarns, in accordance with aspects hereof.

The subject matter of the present disclosure is described with specificity herein to meet statutory requirements. However, the description itself is not intended to limit the scope of the invention. Rather, the claimed or disclosed subject matter might also be embodied in other ways, to include different steps, combinations of steps, elements, or combinations or sub-combinations of elements, similar to the ones described in this document, and in conjunction with other present or future technologies. Moreover, although the terms "step" and/or "block" might be used herein to identify different elements of methods employed, the terms should not be interpreted as implying any particular order among or between various steps herein disclosed unless and except when the order of individual steps is explicitly stated.

Traditional warp knit components may utilize weft inlaid yarns. However, in these traditional warp knit constructions, the weft inlaid yarn extends through a knit loop of a particular warp knit course at every warp knit wale that the weft inlaid yarn crosses. As such, there is no ability to change the direction of the weft inlaid yarn in a material flow direction. Stated differently, traditional weft inlaid yarns uniformly extend orthogonal to a material flow direction.

Aspects herein are directed to a warp knit component, an upper formed from the warp knit component, and methods of manufacturing the warp knit component where the warp knit component includes at least a first front weft inlaid yarn that changes direction in a material flow direction. In example aspects, the first front weft inlaid yarn is at least partially positioned on a first side of a hypothetical midline that extends parallel to a material flow direction of the warp knit component. The first front weft inlaid yarn extends through one or more loops in a first warp knit course, and after extending through the one or more loops, the first front weft inlaid yarn extends as a float positioned on a technical face or front side of the warp knit component. After extending as the float, the first front weft inlaid yarn extends through one or more loops in a second warp knit course that is offset in the material flow direction from the first warp knit course. Using floats facilitates the advancement of the first front weft inlaid yarn in the material flow direction.

In example aspects, the warp knit component may further include a second front weft inlaid yarn that is at least partially positioned on an opposite second side of the hypothetical midline. The second front weft inlaid yarn may have different characteristics than the first front weft inlaid yarn including a different type of yarn, a different color, a different denier, a different texture, a different tenacity, and the like. The second front weft inlaid yarn extends through one or more loops in a third warp knit course, and after extending through the one or more loops, the second front weft inlaid yarn extends as a float positioned on the technical face or front side of the warp knit component. After extending as the float, the second front weft inlaid yarn extends through one or more loops in a fourth warp knit course that is offset in the material flow direction from the third warp knit course. In example aspects, one or more of the third and fourth warp knit courses may be offset from one or more of the first and second warp knit courses in a wale-wise direction. Moreover, a length and/or directionality of the float for the second front weft inlaid yarn may be different than the first front weft inlaid yarn, and the number of loops through which the second front weft inlaid yarn extends in the third and/or fourth warp knit courses may be different than the first front weft inlaid yarn. The result is a different pattern or visual arrangement of elements of the second front weft inlaid yarn as compared to the first front weft inlaid yarn. As described below, this asymmetric patterning as well as the ability to use different types and/or deniers of yarns for the first and second front weft inlaid yarns may be used to achieve different functional effects on the different sides of the warp knit component.

Aspects herein also contemplate that the pattern formed by the first front weft inlaid yarn and the second front weft inlaid yarn may be symmetrical with respect to the hypothetical midline. Moreover, aspects herein contemplate that a same yarn type, denier, color, texture, tenacity, and the like may be used for each of the first front weft inlaid yarn and the second front weft inlaid yarn.

In example aspects, the warp knit component may also include two or more back weft inlaid yarns that respectively extend through every successive loop of the first and second warp knit courses and are generally positioned more toward the technical back of the warp knit component as compared to the front weft inlaid yarns. In one aspect, the back weft inlaid yarns do not change direction in the material flow direction and are oriented orthogonal to the material flow direction of the warp knit component. Thus, the back weft inlaid yarns may help provide structural integrity to the warp knit component. The warp knit component may further include two or more warp inlaid yarns, where each warp inlaid yarn extends through every successive loop of a particular warp knit wale such that the warp inlaid yarns extend parallel to the material flow direction. The warp inlaid yarns may provide additional structural integrity to the warp knit component and prevent distortion of the warp knit component in one or more of the weft direction or the warp direction especially after wash, wear, and use.

When knitting the warp knit component, aspects herein contemplate using a back side weft inlay feeder to insert the back weft inlaid yarns in the warp knit component. Two or more front weft inlay feeders that are capable of moving independently of one another may be used to insert the front weft inlaid yarns. The front weft inlay feeders advance in the material flow direction as the warp knit component is knit.

The warp knit component described herein may be incorporated into a number of different articles. For example, this can include an upper for an article of footwear, and/or an article of footwear, itself. With an upper, the first front weft inlaid yarn may be positioned on a lateral side of the upper, and the second front weft inlaid yarn may be positioned on a medial side of the upper. As described above, the ability to achieve asymmetric patterning as well as the ability to use different types and/or deniers of yarns for the first and second front weft inlaid yarns may be used to achieve different functional effects on the medial and lateral sides of the upper. Moreover, in example aspects, loops may be formed by the floats of the first and second front weft inlaid yarns. Based on the patterning of the upper, the loops may be positioned at a throat area of the upper and used to receive a lace or other securing device to help tighten the upper at the throat area.

As used herein, the term "warp knitting" means a knitting process that produces a vertical-loop structure in a flat form having a technical face and a technical back using one or more sets of yarns that are fed from beams to a row of knitting needles. All stitches within a warp knit course are formed at the same time, but each stitch is formed from a separate yarn fed from a separate yarn guide. Stated differently, the loops of one warp knit course are all made simultaneously as the guide bar rises and moves sideways, placing the yarns around the needles to form the loops, which are then pulled down through the loops of the preceding course.

As the warp knit component advances in a material flow direction through the warp knit machine, the plurality of warp knit courses define a plurality of warp knit wales. As such, the warp knit wales extend in the material flow direction. The term "material flow direction" means the direction the warp knit component advances on the warp knit machine as it is being knit and is meant to be unidirectional. The term "wale-wise direction" as used herein is bidirectional extending in both the material flow direction and the opposite direction. The term "course-wise direction" as used herein is bidirectional extending in a direction of a warp knit course and generally orthogonal to the wale-wise direction. The term "technical face" refers to the front or top side of the warp knit component as it is being knit, and the term "technical back" refers to the back side of the warp knit component as it is being knit.

The term "inlaid" or "laid in" when describing a yarn means a yarn that is laid in the stitches during the knitting process but is not used to form any stitches. Stated differently, an inlaid yarn extends through knit loops but is not used to form the knit loops. With respect to warp knitting, traditional techniques involving inlaying yarns include warp insertion and weft insertion. Warp insertion is where an inlaid yarn is inserted in a warp knit wale such that the inlaid yarn extends in the material flow direction. Weft insertion is where an inlaid yarn, which is known as a back weft inlaid yarn herein, is inserted within a warp knit course by a back side weft inlay feeder such that the back weft inlaid yarn extends through each knit loop in a warp knit course and is oriented orthogonal to the material flow direction. In example aspects, the back weft inlaid yarn is positioned more toward the technical back of the warp knit component as compared to the front weft inlaid yarn. The term "float" as used herein with respect to the front weft inlaid yarn means a portion of the inlaid yarn that does not extend through loops of a warp knit course, but instead is positioned on top of the technical face of the warp knit component. The term "unitary knit" or "integrally knit" means a warp knit component that is formed during a single warp knitting event or process. As such, a particular yarn may extend through multiple different areas of the warp knit component.

The term "upper" when describing an article of footwear (e.g., a shoe) means the portion of the article of footwear that extends above the sole and covers the front, sides, and/or back of the article of footwear. The term "medial" when describing the upper means toward the midline of the body when the article of footwear is worn, and the term "lateral" when describing the upper means away from the midline of the body when the article of footwear is worn. The term "outer-facing" when referring to an upper or an article of footwear incorporating the upper means the surface that faces away from an interior void of the article of footwear. In example aspects, the outer-facing surface of the upper or the article of footwear comprises an outermost-facing surface that is exposed to the external environment.

Warp knitting is different from weft knitting in that it requires different machinery and produces a different knit construction. In example aspects, warp knitting may produce a knit structure that is less prone to unraveling than weft knit structures, shrinks less, and is more dimensionally stable (e.g., less prone to distortion) in both a warp direction and a weft direction than weft knit structures, and can be produced economically at a large scale. Traditionally, it has been difficult to engineer-in zonal properties into warp knit fabrics compared to weft knit fabrics due to differences in how these fabrics are made. For example, changing yarns to create zonal properties is generally easier in a weft knit machine than a warp knit machine as changing the yarns in a warp knit machine can be time consuming and tedious. Aspects described herein may be used to engineer-in zonal properties to a warp knit component, which is useful for articles of apparel such as shoe uppers where different zonal properties may be desired on, for example, the lateral and medial sides of the upper.

FIG. 1 depicts a schematic of a portion of a warp knit component 100 that includes a first front weft inlaid yarn 110 and a plurality of back weft inlaid yarns 112. The warp knit component 100 shown in FIG. 1 is depicted as including both the yarn 110 and the yarns 112. However, it should be noted that in different aspects, a warp knit component, e.g., such as the warp knit component 100, may include the yarns 112 without including the yarn 110, or alternatively, may include the yarn 110 without including the yarns 112, in accordance with different aspects contemplated herein. For example, a warp knit component, e.g., one similar to the warp knit component 100 shown in FIG. 1, may include a plurality of warp knit courses and a weft inlaid yarn that extends through at least one loop of a warp knit course of the plurality of warp knit courses, and after extending through the at least one loop of the warp knit course, the weft inlaid yarn then extends as a float positioned on a technical face of the warp knit component.

Looking still at FIG. 1, the warp knit component 100 includes a plurality of warp knit courses 114 including a first warp knit course 114*a* and a second warp knit course 114*b*. The plurality of warp knit courses 114 form a plurality of warp knit wales 116. The plurality of warp knit courses 114 extend in a course-wise direction 118, and the plurality of warp knit wales 116 extend in a wale-wise direction 121. The material flow direction of the warp knit component 100 is indicated by the reference numeral 120. Although not shown, aspects herein contemplate that the warp knit component 100 may further include a plurality of warp inlaid yarns that extend through the loops of the warp knit wales 116 in the wale-wise direction 121.

The type, e.g., material or combination of materials, denier, and/or other features of the yarns (e.g., color, texture, tenacity, and the like) used to form the plurality of warp knit courses 114, the first front weft inlaid yarn 110, and/or the plurality of back weft inlaid yarns 112 may be the same or may be different. For example, the first front weft inlaid yarn 110 may include a different yarn type, a different denier, a different color, and/or another different property than the yarns used to form the plurality of warp knit courses 114 and/or the plurality of back weft inlaid yarns 112. The yarn type, color, denier, tenacity, and the like selected for the first front weft inlaid yarn 110 may achieve desired functional effects such as strength and/or tenacity (e.g., through use of para-aramid yarns, braided yarns, and the like), reflectivity, light emission (e.g., optical cables), aesthetics (e.g., different colored yarns), and the like.

In different aspects, the yarns forming parts of a warp knit component, e.g., such as the warp knit component 100 shown in FIG. 1, can be polyester, nylon, rayon, cotton, wool, and/or other natural or synthetic materials. In addition, the yarns in a warp knit component can be selected from a range of possible deniers. For example, in some instances, the yarns included in a warp knit component can be from about 150 denier to about 1,000 denier. The needle gauge of a knitting machine that manipulates such yarns can be selected to correspond with the denier or range of deniers of the yarns being used. In additional aspects, the yarns included in a warp knit component, e.g., to form warp knit courses, to form front weft inlaid yarns, and/or to form back weft inlaid yarns, can be multi-component yarns. For example, these yarns can be bi-component yarns, e.g., those having a core and a sheath, and/or can be other types of multi-component yarns. In some aspects, the yarns included in a warp knit component can also include a thermoplastic polymer material, e.g., one that has a melting temperature that is lower than other parts of the yarn (e.g., its core) and/or lower than other yarns included in the warp knit component. In addition, in some aspects, the yarns included in a warp knit component may include or be formed from a thermoplastic elastomer. In one particular example, the warp knit component includes a yarn having a core and a sheath, the sheath being formed of a thermoplastic material, e.g., a thermoplastic polyurethane and/or a thermoplastic elastomer, and the core being formed from a non-thermoplastic material.

In addition, in instances where a thermoplastic material is used as discussed above, the resulting warp knit component can be heat-processed to at least partially melt, re-flow, and then cool/re-solidify the thermoplastic material to thereby produce a thermoformed network of yarns that are at least partially interconnected. The melting, re-flowing, and solidifying of such materials can be used to impart different properties to a warp knit component, e.g., increased frictional resistance, increased grip, increased tackiness, increased stretch-resistance, increased water-resistance or water-proofing, increased transparency or translucence, formation of a skin layer, or other properties. The portions of a warp knit component that include a thermoformed network can therefore also have different surface properties compared to portions of the warp knit component formed with other yarns. It should be noted that the different yarns discussed in these sections can be used in any of the warp knit components described herein.

The warp knit components disclosed herein can also include integrated tensile elements. For example, one or more tensile elements may be inlaid into a warp knit component during a knitting process to impart a higher stretch-resistance along desired lines of reinforcement and/or containment, e.g., as compared to other yarns or structures forming parts of the warp knit component. The tensile elements can be an inlaid strand, an inlaid fiber, an inlaid filament (e.g., mono-filament or multi-filament), and/or an inlaid cable, among other reinforcing components. In addition, a braided cable can be used, and/or a high-tenacity yarn, fiber, and/or filament (e.g., one having a tenacity of at least 5 grams per denier (g/D)) can be used. The tensile elements in different aspects can be formed of glass, aramids, ultra-high molecular weight polyethylene, liquid crystal polymer, or other polymers or materials.

Looking still at FIG. 1, in different aspects, the back weft inlaid yarns 112 extend through every successive loop within a particular warp knit course of the plurality of warp knit courses 114. For example, in one aspect, the back weft inlaid yarns 112 extend through at least every successive loop in the first warp knit course 114*a* and the second warp knit course 114*b*. Aspects herein further contemplate that the plurality of back weft inlaid yarns 112 extend through every successive loop of each warp knit course in the plurality of warp knit courses 114 as shown.

In some aspects, the warp knit component 100 may include an area 122 that does not include the plurality of warp knit courses 114. In example aspects, the area 122 may be formed when yarn guides located on the warp bar at a location corresponding to the area 122 do not feed in yarns. As a result, the area 122 does not include any warp knit wales. As shown, the plurality of back weft inlaid yarns 112 extend in the course-wise direction 118 across the area 122 to provide structural integrity to the warp knit component 100. Eliminating warp knit courses at the area 122 can reduce the overall weight of the warp knit component 100, among other benefits.

In accordance with aspects herein, it is contemplated that the warp knit component 100 may not include the area 122. In such instances, the plurality of warp knit courses 114 may extend without interruption in the course-wise direction 118 of the warp knit component 100 forming additional warp knit wales 116 within the area 122. This may be desirable when a heavier weight warp knit component or a warp knit component with more coverage is desired.

In addition, in different aspects, the relative position, spacing, and/or orientation of the yarns 110 (including the float 124) and the yarns 112 can be different. This can as a result produce a smaller or larger area 122 relative to what is shown in FIG. 1. In addition, in different aspects, yarns that include a thermoplastic material may be used in the warp knit component 100, and these yarns can then be heated, re-flowed, and then cooled/re-solidified to produce a thermoformed network with different properties (e.g., higher friction, higher grip, higher tackiness, higher stretch-resistance, transparence or translucence, or other properties), e.g., as described in paragraph [0028] herein. In addition, selective heat-processing of these thermoplastic materials can produce thermoformed networks in certain areas with desired properties, while also helping to maintain a lighter weight material, and increase durability and abrasion-resistance.

In some aspects, the first front weft inlaid yarn 110 extends through one or more successive loops in the first warp knit course 114*a*. In the area 122, the first front weft inlaid yarn 110 extends as a float 124 positioned on a technical face or front side of the warp knit component 100. To state it differently, the float 124 is positioned in front of the plurality of back weft inlaid yarns 112 when the warp knit component 100 is viewed from the technical face. In aspects in which the area 122 includes warp knit wales, then the float 124 would extend over one or more successive warp knit wales similar to the warp knit wales 116. Looking at FIG. 1, the float 124 extends at least partially in the material flow direction 120. Then, after extending as the float 124, the first front weft inlaid yarn 110 extends through one or more successive loops in the second warp knit course 114*b*. Because the float 124 extends in the material flow direction 120, the second warp knit course 114*b* is offset in the material flow direction 120 from the first warp knit course 114*a*. In FIG. 1, the float 124 is shown extending over one intervening warp knit course 114. However, in other aspects contemplated herein, there may not be an intervening warp knit course 114, or, alternatively, there may be more than one intervening warp knit course 114, e.g., 2, 3, 4, 5, or more intervening warp knit courses. The knitting technique described herein facilitates a change in direction of the first front weft inlaid yarn 110 in the material flow direction 120 such that at least a portion of the length of the first front weft inlaid yarn 110 (e.g. the float 124) is not orthogonal to the material flow direction 120. In different aspects, the change in direction of a yarn in a given section of a warp knit component can be between 1-180 degrees, e.g., being a change of 30 degrees, 60 degrees, 90 degrees, or even 180 degrees to obtain a full reversal of direction, either along a common course, or along adjacent or spaced courses.

The length, directionality, and/or orientation of a float included in the warp knit components discussed herein can differ. For example, the length, directionality, and/or orientation of the float 124 shown in FIG. 1 can change based on a number of factors. For instance, increasing the width of the area 122, or the number of warp knit wales 116 if used, in the course-wise direction and/or increasing the number of intervening warp knit courses between the first warp knit course 114*a* and the second warp knit course 114*b* can increase the length of the float 124. Similarly, decreasing the width of the area 122, or the number of warp knit wales 116, if used, and/or decreasing the number of intervening warp knit courses between the first warp knit course 114*a* and the second warp knit course 114*b* can decrease the length of the float 124. The degree of slope, directionality, and/or angularity of the float 124 may be increased if the width of the area 122, or the number of warp knit wales 116, if used, in the course-wise direction 118 is reduced, and the slope, directionality, and/or angularity of the float 124 may be decreased if the width of the area 122, or the number of warp knit wales 116, if used, in the course-wise direction 118 is increased.

Figure 2:
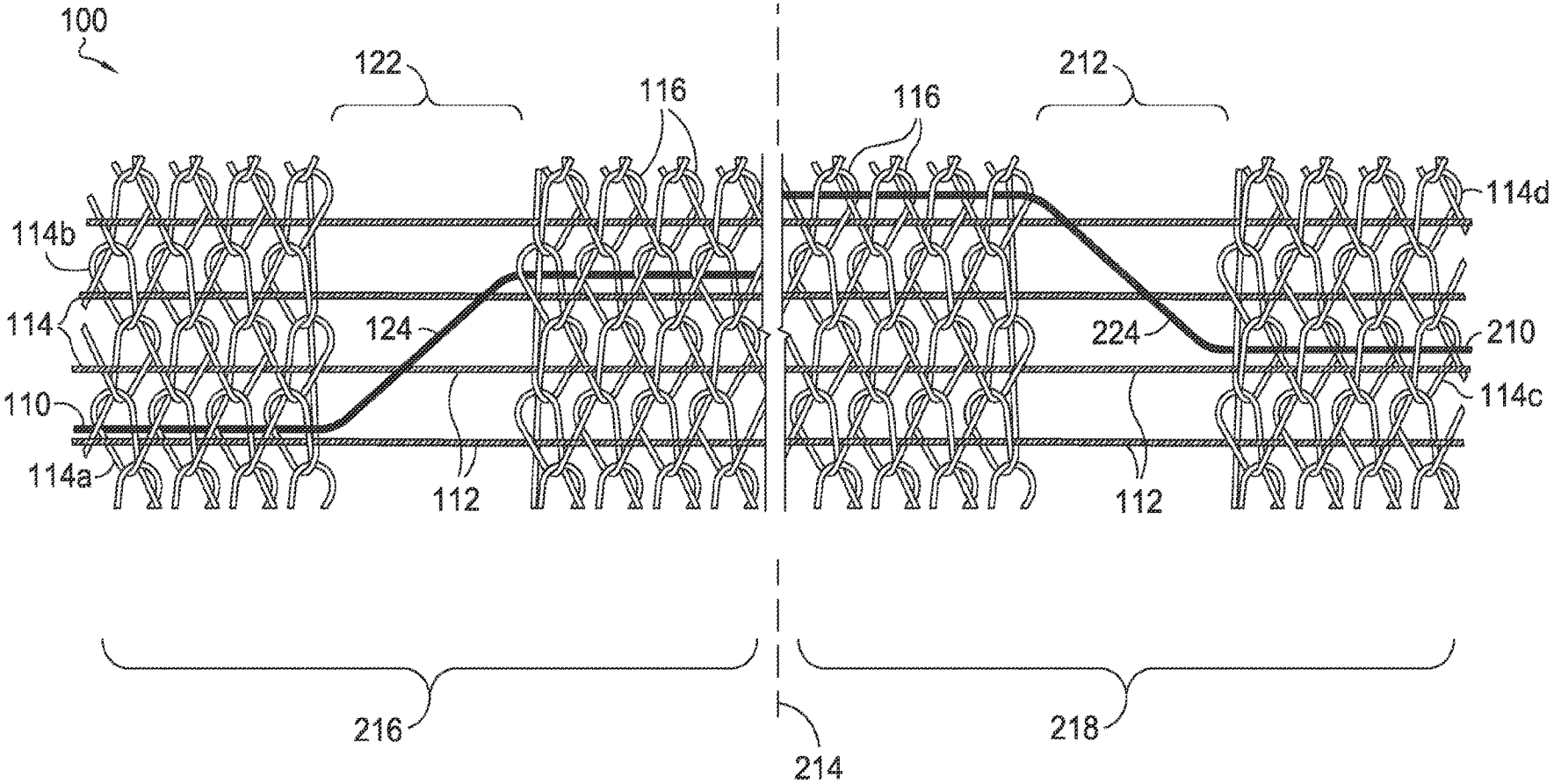
FIG. 2 depicts a schematic of a larger portion of the warp knit component of FIG. 1 and further illustrates a second front weft inlaid yarn, in accordance with aspects hereof.

FIG. 2 depicts a larger portion of the warp knit component 100 and further includes a second front weft inlaid yarn 210. In FIG. 2, the warp knit component 100 is bisected by a hypothetical midline 214 that extends in the material flow direction 120 and bisects the warp knit component 100 into a first side 216 and a second side 218 that are generally equal sized. A break line is also shown to indicate that the warp knit component 100 may include additional knit material between the first and second sides 216 and 218. The first front weft inlaid yarn 110 is depicted positioned on the first side 216 of the warp knit component 100, and the second front weft inlaid yarn 210 is depicted positioned on the opposite second side 218 of the warp knit component 100. The description given above for the first front weft inlaid yarn 110 is further applicable to FIG. 2 and thus will not be repeated.

With respect to the second front weft inlaid yarn 210, the second front weft inlaid yarn 210 extends through one or more successive loops in a third warp knit course 114*c* of the plurality of warp knit courses 114. At area 212, the second front weft inlaid yarn 210 extends as a float 224 positioned on the technical face or front side of the warp knit component 100. To state it differently, the float 224 is positioned in front of the plurality of back weft inlaid yarns 112 when the warp knit component 100 is viewed from the technical face. In aspects in which the area 122 includes warp knit wales, then the float 224 would extend over one or more successive warp knit wales similar to the warp knit wales 116. In FIG. 2, the float 224 extends at least partially in the material flow direction 120. After extending as the float 224, the second front weft inlaid yarn 210 extends through one or more successive loops in a fourth warp knit course 114*d* of the plurality of warp knit courses 114. Because the float 224 extends in the material flow direction 120, the fourth warp knit course 114*d* is offset in the material flow direction 120 from the third warp knit course 114*c*. Although the float 224 is shown extending over one intervening warp knit course 114, aspects herein contemplate that there may not be an intervening warp knit course 114 or, alternatively, that there may be more than one intervening warp knit course 114, e.g., there being 2, 3, 4, 5, or more intervening warp knit courses. In some aspects, the float 124 can change direction without any intervening courses, e.g., changing direction substantially within the same course.

As shown in FIG. 2, at least one of the first warp knit course 114*a* and the second warp knit course 114*b* is offset in the wale-wise direction 121 from at least one of the third warp knit course 114*c* and the fourth warp knit course 114*d*. In example aspects, each of the first, second, third, and fourth warp knit courses 114*a*, 114*b*, 114*c*, and 114*d* may be offset from each other in the wale-wise direction 121. However, aspects herein also contemplate that the third warp knit course 114*c* may be the same as the first warp knit course 114*a*, and/or that the fourth warp knit course 114*d* may be the same as the second warp knit course 114*b*. Although FIG. 2 depicts the float 224 extending over the same number of intervening warp knit courses 114 as the float 124, aspects herein contemplate that the float 124 and the float 224 may extend over a different number of intervening warp knit courses 114.

Like the first front weft inlaid yarn 110, the length and the directionality of the float 224 may vary depending on a number of factors. For example, increasing the width of the area 212 in the course-wise direction, increasing the number of warp knit wales 116, if used, and/or increasing the number of intervening warp knit courses between the third warp knit course 114*c* and the fourth warp knit course 114*d* increases the length of the float 224. In a similar fashion, decreasing the width of the area 212, decreasing the number of warp knit wales 116, if used, and/or decreasing the number of intervening warp knit courses between the third warp knit course 114*c* and the fourth warp knit course 114*d* decreases the length of the float 224. The degree of slope, directionality, and/or angularity of the float 224 may be increased if the width of the area 212, the number of warp knit wales 116, if used, in the course-wise direction 118 is reduced, and the slope, directionality, and/or angularity of the float 224 may be decreased if the width of the area 212, or the number of warp knit wales 116, if used, is increased.

Although not shown, each of the first front weft inlaid yarn 110 and the second front weft inlaid yarn 210 may change direction in the course-wise direction 118 one or more times to create a "zig-zag" patterning for each of the first and second front weft inlaid yarns 110 and 210 in the warp knit component 100.

The result of this construction is the ability to create an asymmetric pattern of the first front weft inlaid yarn 110 and the second front weft inlaid yarn 210 for each of the first side 216 and the second side 218 of the warp knit component 100. As used herein, the term "pattern" refers to a visual arrangement of elements. With respect to the first and second front weft inlaid yarns 110 and 210, the elements include a series of variable length linear segments including linear segments that are oriented orthogonal to the material flow direction 120 and linear segments that are oriented non-orthogonal (e.g., diagonal) to the material flow direction 120. Thus, the arrangement of the linear segments created respectively by the first and second front weft inlaid yarns 110 and 210 differs between the first side 216 and the second side 218. Moreover, the first front weft inlaid yarn 110 and the second front weft inlaid yarn 210 may be a different yarn type, denier, texture, color, tenacity, and the like to further create asymmetry between the first side 216 and the second side 218 of the warp knit component 100. This asymmetry may be leveraged to create zonal or localized properties in articles formed from the warp knit component 100 as described below. Aspects herein also contemplate creating a symmetric pattern for each of the first front weft inlaid yarn 110 and the second front weft inlaid yarn 210 on the first side 216 and the second side 218 of the warp knit component 100.

Although only one front weft inlaid yarn is depicted for each of the first side 216 and the second side 218 of the warp knit component 100, it is contemplated herein that each of the first side 216 and the second side 218 may include multiple or a plurality of front weft inlaid yarns. In example aspects, when multiple front weft inlaid yarns are included on the first side 216 and/or the second side 218, the additional front weft inlaid yarns may have the same or a similar pattern as the respective first front weft inlaid yarn 110 and the second front weft inlaid yarn 210 shown in FIG. 2. Additionally or alternatively, one or more of the additional front weft inlaid yarns may have a different pattern than the first front weft inlaid yarn 110 or the second front weft inlaid yarn 210. Moreover, the additional front weft inlaid yarns may be different yarn types, deniers, colors, textures, and/or tenacities and the like than the first front weft inlaid yarn 110 and the second front weft inlaid yarn 210. Any and all aspects, and any variation thereof, are contemplated as being within the scope herein.

Figure 3:
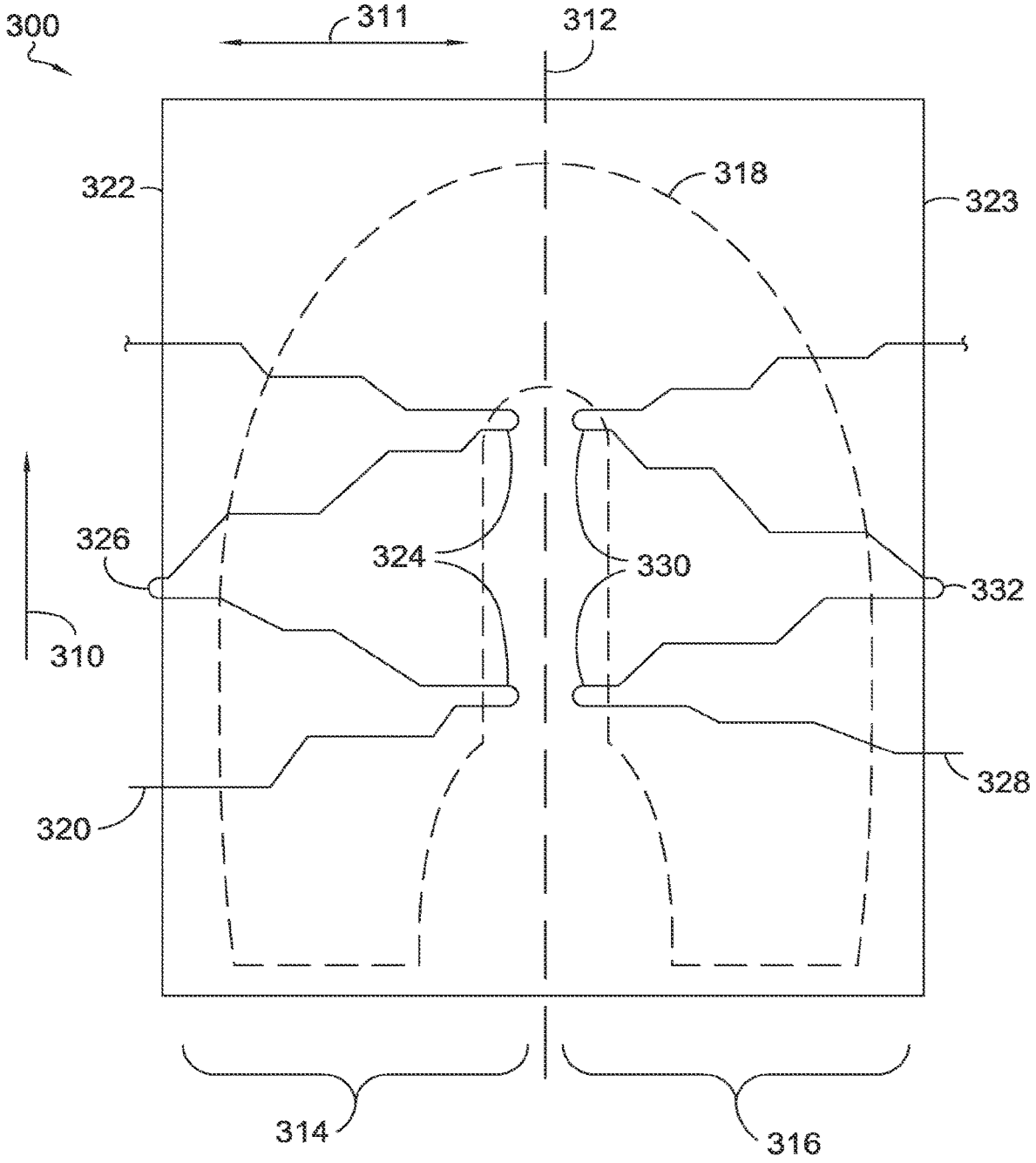
FIG. 3 depicts a warp knit component having first and second front weft inlaid yarns and having an upper pattern positioned thereon, in accordance with aspects hereof.

FIG. 3 depicts a warp knit component 300 constructed in accordance with aspects herein. In FIG. 3, a material flow direction is indicated by reference numeral 310, a course-wise direction is indicated by reference numeral 311, and a hypothetical midline is indicated by reference numeral 312, and the hypothetical midline 312 is oriented parallel to the material flow direction 310. The hypothetical midline 312 divides the warp knit component 300 into a first side 314 and a second side 316. An upper pattern 318 is shown superimposed on the warp knit component 300.

With respect to the first side 314 of the warp knit component 300, a first front weft inlaid yarn 320 is shown extending back and forth between a first side edge 322 of the warp knit component 300 and an area near the hypothetical midline 312. Aspects herein contemplate that the first front weft inlaid yarn 320 may also be positioned inward from the first side edge 322 such that the first front weft inlaid yarn 320, or portions thereof, does not extend to the first side edge 322. The pattern for the first front weft inlaid yarn 320 is depicted schematically such that the linear segments that are oriented orthogonal to the material flow direction 310 represent where the first front weft inlaid yarn 320 extends through successive loops in a plurality of warp knit courses that are offset from each other in the material flow direction 310, e.g., such as the first and second warp knit courses 114*a* and 114*b*. Linear segments that are oriented non-orthogonal to the material flow direction 310 (e.g., diagonal or parallel) represent where the first front weft inlaid yarn 320 floats in the material flow direction 310, e.g., as with the float 124.

The pattern illustrated for the first front weft inlaid yarn 320 is intended as an example and other patterns are contemplated herein. For example, the pattern may extend over a greater portion of the warp knit component 300 in the wale-wise direction. Moreover, aspects herein contemplate that the first front weft inlaid yarn 320 may extend across the hypothetical midline 312 and into the second side 316 before changing direction back toward the first side edge 322.

Loops 324 are formed near the hypothetical midline 312 when the first front weft inlaid yarn 320 changes direction in the course-wise direction 311 and begins to extend in a direction toward the first side edge 322. The loops 324 represent floats formed by the first front weft inlaid yarn 320 as the warp knit component 300 advances in the material flow direction 310. As described below, when the warp knit component 300 is formed into an upper, the loops 324 may be positioned near a throat area of the upper and are configured to receive a lace or other securing device. Additional loops, such as loop 326 may be formed at the first side edge 322 when the first front weft inlaid yarn 320 changes direction in the course-wise direction 311 and begins to extend in a direction toward the hypothetical midline 312. The loop 326 also represents a float formed by the first front weft inlaid yarn 320 as the warp knit component 300 advances in the material flow direction 310. In example aspects, the loop 326 may be used to secure the upper to a sole structure, may be used as a strobel, and/or may be located at or adjacent to a bite line, among other possibilities.

With respect to the opposite second side 316 of the warp knit component 300, a second front weft inlaid yarn 328 is shown extending back and forth between a second side edge 323 of the warp knit component 300 and an area near the hypothetical midline 312. Aspects herein contemplate that the second front weft inlaid yarn 328 may also be positioned inward from the second side edge 323 such that the second front weft inlaid yarn 328, or portions thereof, does not extend to the second side edge 323. The second front weft inlaid yarn 328 may be a same or different yarn type as the first front weft inlaid yarn 320, a same or different denier as the first front weft inlaid yarn 320, a same or different color or texture as the first front weft inlaid yarn 320, and the like. Like the first front weft inlaid yarn 320, the pattern for the second front weft inlaid yarn 328 is depicted schematically such that the linear segments that are oriented orthogonal to the material flow direction 310 represent where the second front weft inlaid yarn 328 extends through successive loops in a plurality of warp knit courses that are offset from each other in the material flow direction 310, e.g., as with the third and fourth warp knit courses 114*c* and 114*d*. Linear segments that are oriented non-orthogonal to the material flow direction 310 (e.g., diagonal or parallel) represent where the second front weft inlaid yarn 328 floats in the material flow direction 310, e.g., like the float 224.

The pattern illustrated for the second front weft inlaid yarn 328 is illustrative and other patterns are contemplated herein. For example, the pattern may extend over a greater portion of the warp knit component 300 in the wale-wise direction. Moreover, aspects herein contemplate that the second front weft inlaid yarn 328 may extend across the hypothetical midline 312 and into the first side 314 before changing direction back toward the second side edge 323. Moreover, aspects herein contemplate that both the first and second front weft inlaid yarns 320 and 328 may extend across the hypothetical midline 312 such that the first and second front weft inlaid yarns 320 and 328 intersect or cross over each other before changing direction back toward their respective side edges 322 and 323. In this example, the first and second front weft inlaid yarns 320 and 328 would be generally aligned in the course-wise direction 311. Any and all aspects, and any variation thereof, are contemplated as being within aspects herein.

Loops 330 are formed near the hypothetical midline 312 when the second front weft inlaid yarn 328 changes direction in the course-wise direction 311 and begins to extend in a direction toward the second side edge 323. In example aspects, the loops 330 are aligned in the course-wise direction 311 with the loops 324. The loops 330 represent floats formed by the second front weft inlaid yarn 328 as the warp knit component 300 advances in the material flow direction 310. Like the loops 324, the loops 330 may be positioned near the throat area of the upper and can be configured to receive a lace or other securing device. Additional loops, such as loop 332 may be formed at the second side edge 323 when the second front weft inlaid yarn 328 changes direction in the course-wise direction 311 and begins to extend in a direction toward the hypothetical midline 312. The loop 332 also represents a float formed by the second front weft inlaid yarn 328 as the warp knit component 300 advances in the material flow direction 310. Like the loop 326, the loop 332 may be used to secure the upper to a sole structure, may be used as a strobel, and/or may be located at or adjacent to a bite line, among other possibilities.

In FIG. 3, the first front weft inlaid yarn 320 creates a different pattern on the first side 314 of the warp knit component 300 compared to the second front weft inlaid yarn 328 on the second side 316 of the warp knit component 300. As described above, the asymmetric pattern created by the first and second front weft inlaid yarns 320 and 328 may be due to varying the number of successive loops through which the first and second front weft inlaid yarns 320 and 328 extend in a respective warp knit course, varying the number of intervening warp knit courses over which the floats formed by the first and second front weft inlaid yarns 320 and 328 extend, varying the number of intervening warp knit wales (when used) over which the floats formed by the first and second front weft inlaid yarns 320 and 328 extend, varying the width of areas, such as areas 122 and 212 of FIG. 2, in the course-wise direction 311, and the like. Aspects herein also contemplate a symmetric pattern on the first side 314 and the second side 316 of the warp knit component 300.

Figure 4:
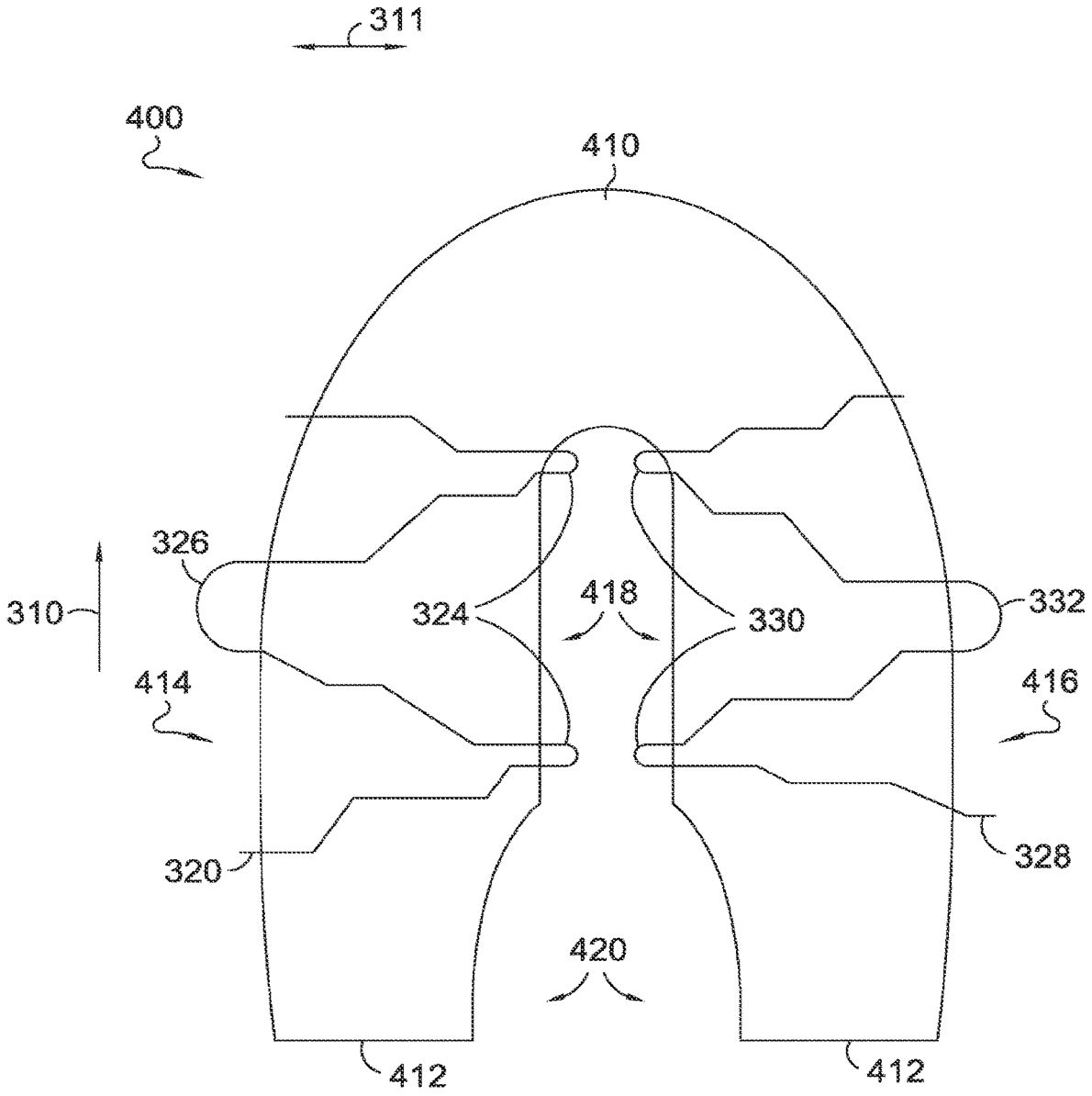
FIG. 4 depicts the upper removed from the warp knit component of FIG. 3, in accordance with aspects hereof.

FIG. 4 depicts an upper 400 that has been removed from the warp knit component 300 shown in FIG. 3. The upper 400 includes a toe end 410, respective heel ends 412, a lateral side 414, a medial side 416, a throat area 418, and an ankle opening 420. The configuration shown for the upper 400 is illustrative, and it is contemplated herein that the upper 400 may have different configurations than that shown. The upper 400 can be integrated into an article of footwear, e.g., a shoe, such that it forms at least a portion of the article of footwear.

In FIG. 4, as depicted, the loops 324 and 330 formed respectively by the first front weft inlaid yarn 320 and the second front weft inlaid yarn 328 are positioned adjacent to the throat area 418 of the upper 400. Further, the loops 326 and 332 formed respectively by the first front weft inlaid yarn 320 and the second front weft inlaid yarn 328 are positioned adjacent to the edges of the upper 400 on the lateral side 414 and the medial side 416, respectively. In different aspects, one or more of the loops 324, 330, 326, and 332 may be cut when removing the upper 400 from the warp knit component 300.

Figure 5:
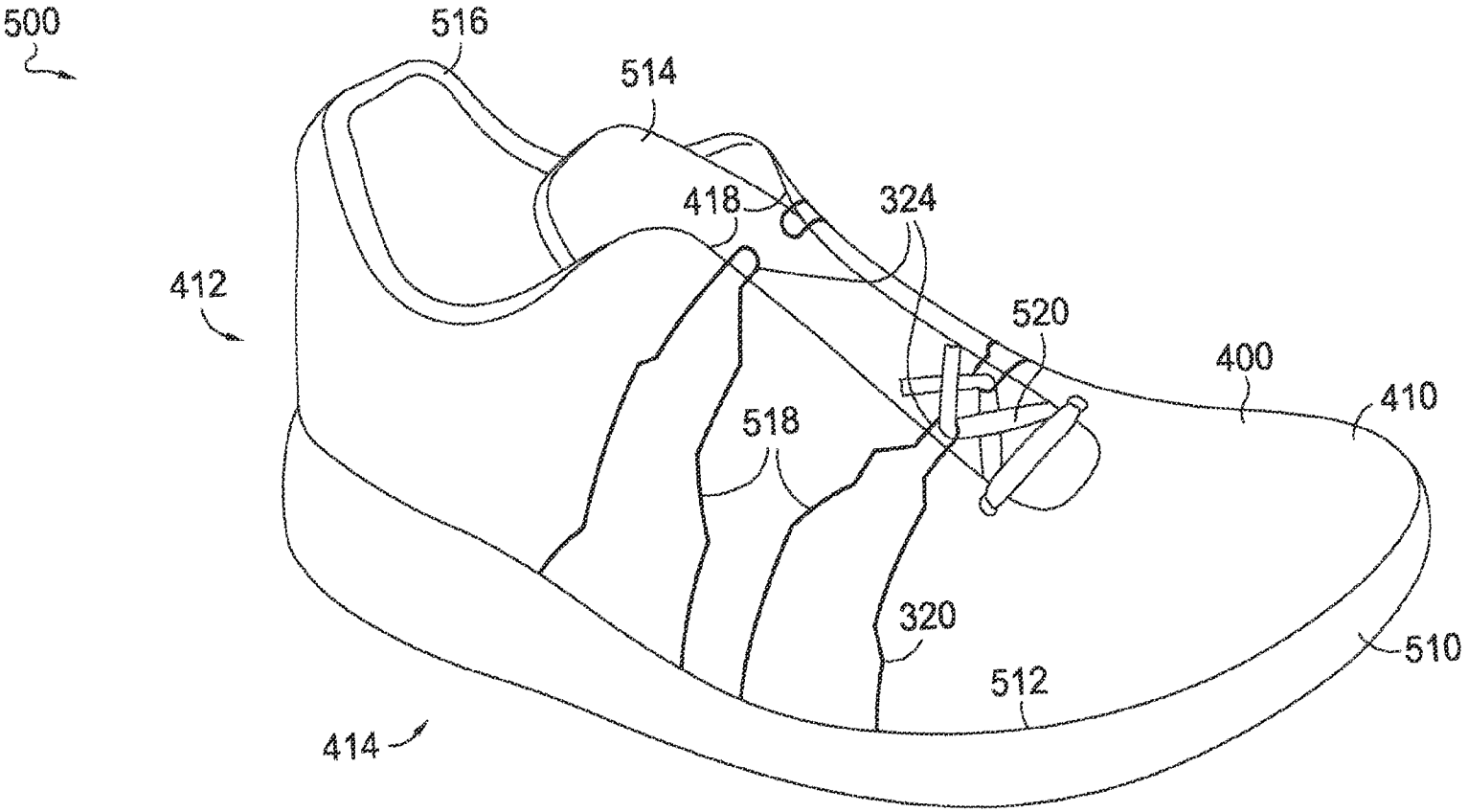
FIGS. 5 and 6 respectively depict a lateral view and a medial view of an article of footwear incorporating the upper of FIG. 4, in accordance with aspects hereof.

FIG. 5 generally depicts the lateral side 414 of the upper 400 incorporated into an article of footwear 500. The article of footwear 500 is in the form of a sport or athletic shoe and includes a sole structure 510 that is secured to a lower edge or area 512 of the upper 400. The article of footwear 500 may include additional components such as a tongue 514 located in the throat area 418 of the upper 400, and an ankle collar 516 secured to the ankle opening 420 of the upper 400 that defines an opening for receiving a wearer's foot. The upper 400 is incorporated into the article of footwear 500 such that the warp knit courses extend generally between a medial side and a lateral side of the article of footwear 500 and the warp knit wales extend generally in a toe-to-heel direction of the article of footwear 500.

In one aspect, the inlay(s) of a warp knit component discussed herein can extend at least partially through a toe area in the heel-to-toe direction to increase stretch-resistance or containment in the toe area. In further aspects, the inlay(s) may extend through a medial area, through a lateral area, through a heel area, through a throat area, and/or through a vamp area, or through another area or through any combination thereof. This can be used to enhance containment and stretch-resistance in the localized areas in which the inlay is incorporated.

The configuration of the article of footwear 500 shown in FIG. 5 is illustrative, and it is contemplated herein that the article of footwear 500 may assume other configurations, e.g., such as a tongueless configuration, a configuration with an ankle cuff, or another configuration.

In FIG. 4, the lateral side 414 of the upper 400 forms, at least in part, a lateral side of the article of footwear 500 shown in FIG. 5. The first front weft inlaid yarn 320 is again schematically depicted and extends from the lower edge or area 512 of the upper 400 to the throat area 418. The floats, such as floats 518, are positioned on an outermost-facing surface of the upper 400 and of the article of footwear 500. The loops 324 formed by the first front weft inlaid yarn 320 extend into the throat area 418 of the upper 400. In some aspects, the article of footwear 500 can include a lace 520 (a portion of which is shown in FIG. 5 for example purposes) that extends through an opening formed by the loops 324. The lace 520 can thus be used to secure the article of footwear 500 around a foot of a wearer. Although a lace is depicted, other types of securing devices are contemplated herein. Although not shown, aspects herein contemplate that the loop 326 shown in FIG. 3 that is formed by the first front weft inlaid yarn 320 can be used to secure the upper 400 to the sole structure 510 and/or to a strobel.

Figure 6:
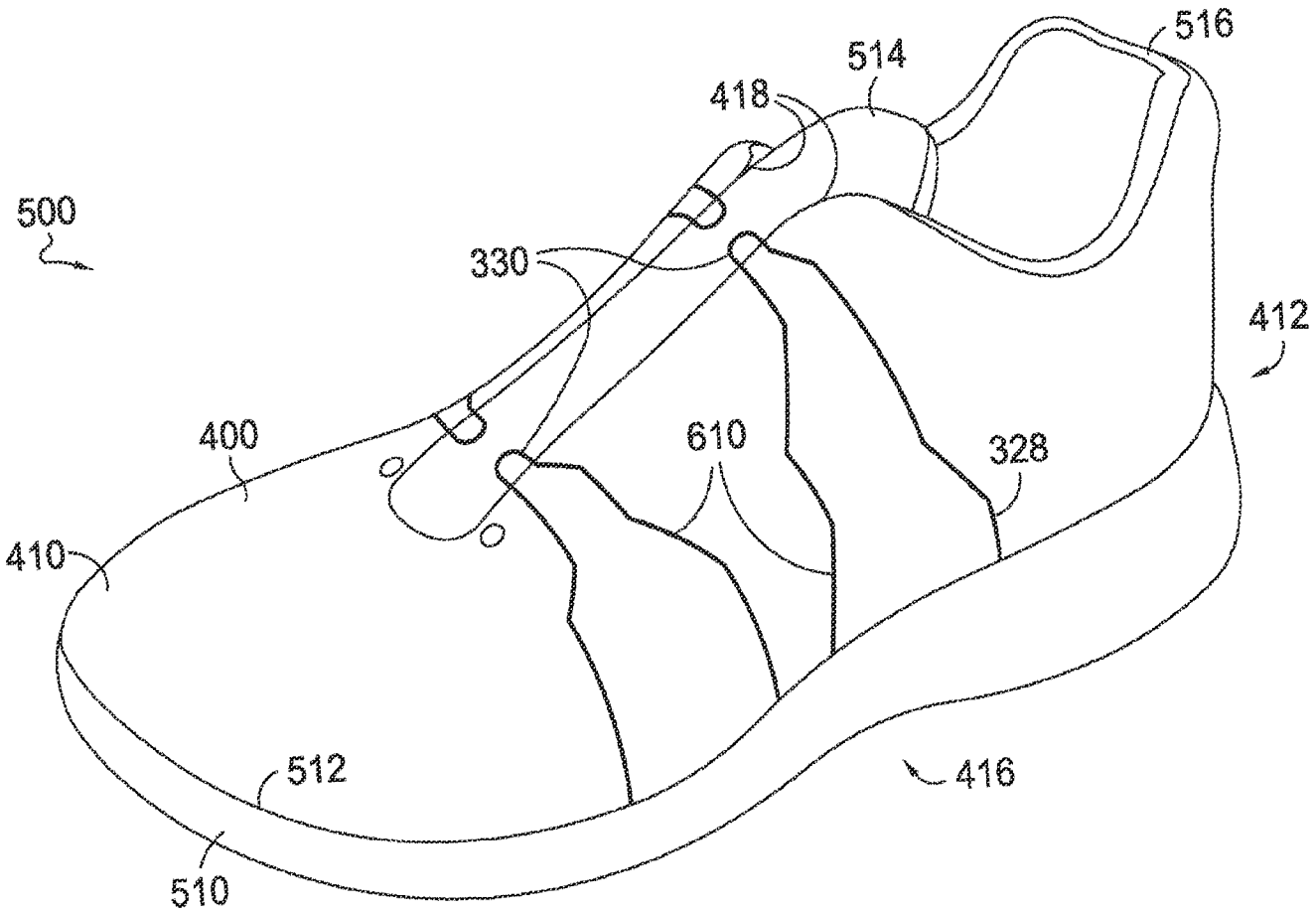

FIG. 6 generally depicts the medial side 416 of the upper 400 incorporated into the article of footwear 500. However, the portion of the lace 520 is not shown in FIG. 6. In FIG. 6, the medial side 416 of the upper 400 forms, at least in part, a medial side of the article of footwear 500. The second front weft inlaid yarn 328 is again schematically depicted and extends from the lower edge or area 512 of the upper 400 to the throat area 418 of the upper 400. The floats, such as floats 610, are positioned on the outermost-facing surface of the upper 400 and of the article of footwear 500. The loops 330 formed by the second front weft inlaid yarn 328 extend into the throat area 418 of the upper 400 where the loops 330 are configured to receive, for example, the lace 520. Although not shown, aspects herein contemplate that the loop 332 formed by the second front weft inlaid yarn 328 may be used to secure the upper to the sole structure 510 and/or to a strobel.

As described above with respect to FIG. 4, the first and second front weft inlaid yarns 320 and 328 produce different patterns on the lateral side 414 and the medial side 416 of the upper 400. The types and/or denier of the first and second front weft inlaid yarns 320 and 328 as well as the pattern formed by the first and second front weft inlaid yarns 320 and 328 may be selected to achieve desired functional effects for each side of the upper 400 and for the article of footwear 500 as a whole. By way of illustrative example, if the article of footwear 500 is potentially subject to greater amount of stress/strain on the lateral side 414 of the upper 400 compared to the medial side 416, e.g., as in sports such as football or basketball, a yarn having a greater tenacity or strength may be selected for the first front weft inlaid yarn 320 compared to the second front weft inlaid yarn 328. Moreover, compared to the second front weft inlaid yarn 328, a greater number of floats having a greater length formed by the first front weft inlaid yarn 320 may be selected to create directional tension to counteract the stress/strain imposed on the lateral side 414 of the upper 400 by a wearer's foot in use.

To provide another example, if the article of footwear 500 is used for sports such as soccer, an enhanced grip may be desired on the medial side 416 of the upper 400. In this example, a higher grip yarn (e.g., a nano-yarn) may be selected for the second front weft inlaid yarn 328 compared to the first front weft inlaid yarn 320. The higher grip yarn can also be one formed at least partially of thermoplastic materials that are heat-processed as previously described. Moreover, compared to the first front weft inlaid yarn 320, a greater number of floats having a greater length formed by the second front weft inlaid yarn 328 may be selected to create a greater grip area on the medial side 416 of the upper 400. These are just examples and are used to illustrate how the particular patterning created by the first and second front weft inlaid yarns 320 and 328 may be selected to achieve desired functional effects, properties, and/or characteristics.

Figure 7:
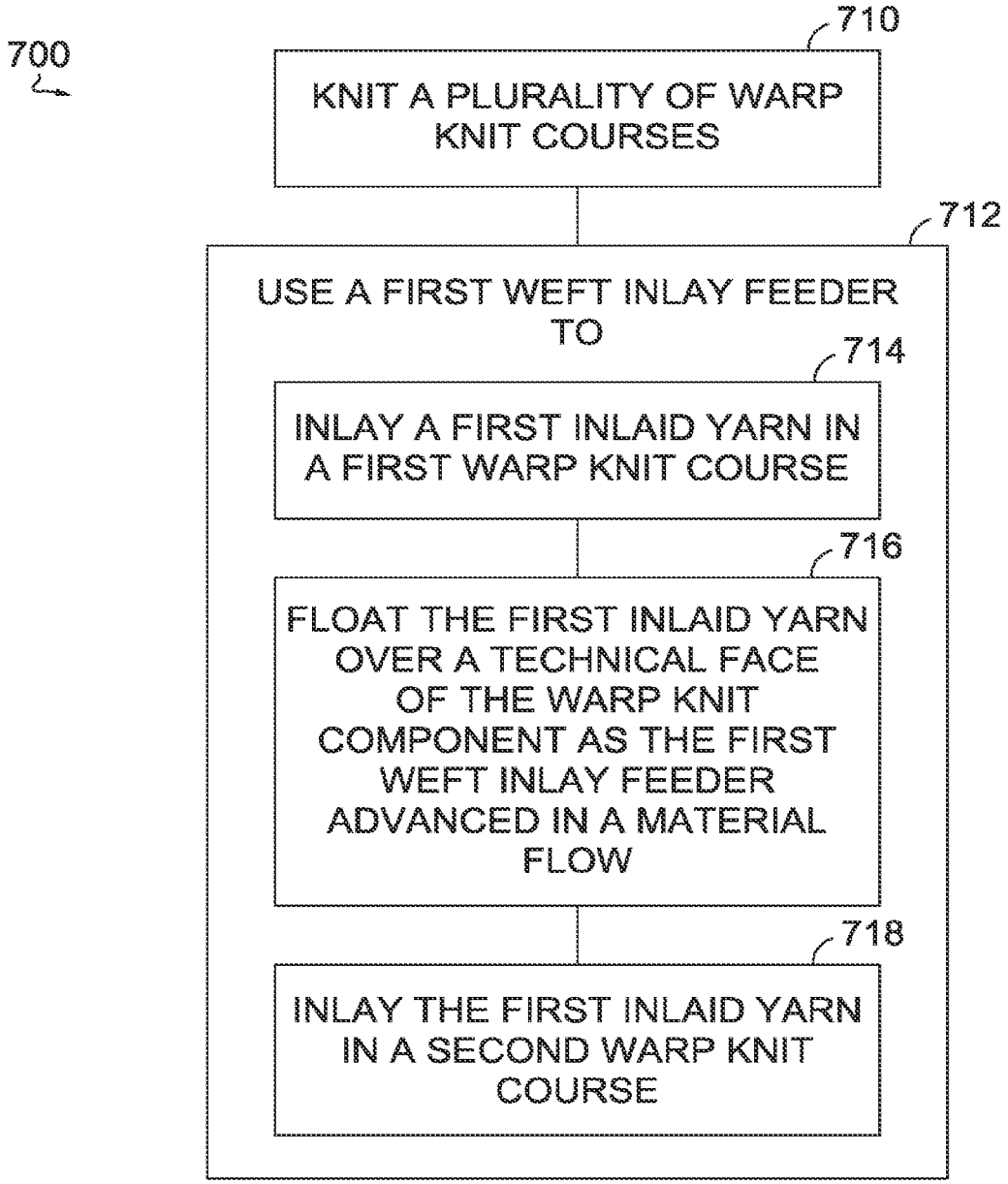
FIG. 7 depicts a block diagram of an example method of manufacturing a warp knit component with front weft inlaid yarns, in accordance with aspects hereof.

FIG. 7 depicts a block diagram of an example method 700 of manufacturing a warp knit component, e.g., the warp knit component 100 shown in FIG. 1, in accordance with aspects hereof. The method 700 includes blocks 710-718 but is not limited to this combination of elements. In block 710, a plurality of warp knit courses are knit using, for example, a warp knit machine. To provide one example, a warp knit machine may be manufactured by Comez® having a United States office located at 2231 Gateway Boulevard, Charlotte, NC, 28266. In block 712, a first front weft inlay feeder is used to inlay a first front weft inlaid yarn, such as the first front weft inlaid yarn 110 shown in FIG. 1, in a first warp knit course, such as the first warp knit course 114*a* shown in FIG. 1, inlaid at a step 714. The first front weft inlaid yarn is inlaid such that it extends through at least one loop in a first warp knit course.

In block 716, as the first front weft inlay feeder advances in the material flow direction, the first front weft inlay feeder floats the first front weft inlaid yarn over a technical face of the warp knit component to form a float, e.g., the float 124 shown in FIG. 1. In block 718, the first front weft inlay feeder inlays the first front weft inlaid yarn in a second warp knit course, e.g., the second warp knit course 114*b* shown in FIG. 1. In example aspects, the first front weft inlaid yarn is inlaid into the second warp knit course such that it extends through one or more successive loops of the course. Because the first front weft inlay feeder is advancing in the material flow direction as it floats the first front weft inlaid yarn, the second warp knit course is offset from the first warp knit course in the material flow direction.

In example aspects, a second weft inlay feeder may be used to inlay and float a second front weft inlaid yarn, e.g., the second front weft inlaid yarn 210. The second front weft inlaid yarn 210 may be inlaid in warp knit courses that are offset from the first and second warp knit courses, e.g., in a wale-wise direction. The result is a different pattern for the first and second front weft inlaid yarns. Additionally, a different yarn type, denier, color, texture, tenacity, and the like may be used for the second front weft inlaid yarn as compared to the first front weft inlaid yarn.

The following clauses represent example aspects of concepts contemplated herein. Any one of the following clauses may be combined in a multiple dependent manner to depend from one or more other clauses. Further, any combination of dependent clauses (clauses that explicitly depend from a previous clause) may be combined while staying within the scope of aspects contemplated herein. The following clauses are intended to represent non-limiting examples.

Clause 1. A warp knit component comprising: a plurality of warp knit courses that form a plurality of warp knit wales; and a first front weft inlaid yarn, wherein: the first front weft inlaid yarn extends through at least one loop in a first warp knit course of the plurality of warp knit courses, after extending through the at least one loop in the first warp knit course, the first front weft inlaid yarn extends as a float positioned on a technical face of the warp knit component, and after extending as the float, the first front weft inlaid yarn extends through at least one loop in a second warp knit course of the plurality of warp knit courses, the second warp knit course offset in a material flow direction from the first warp knit course.

Clause 2. The warp knit component according to clause 1, further comprising a second front weft inlaid yarn, wherein: the second front weft inlaid yarn extends through at least one loop in a third warp knit course of the plurality of warp knit courses, after extending through the at least one loop in the third warp knit course, the second front weft inlaid yarn extends as a float positioned on the technical face of the warp knit component, and after extending as the float, the second front weft inlaid yarn extends through at least one loop in a fourth warp knit course.

Clause 3. The warp knit component according to clause 2, wherein at least one of the first warp knit course and the second warp knit course is offset from at least one of the third warp knit course and the fourth warp knit course in the wale-wise direction.

Clause 4. The warp knit component according to any of clauses 2 through 3, wherein the first front weft inlaid yarn is positioned on a first side of a hypothetical midline that extends in a material flow direction of the warp knit component, and wherein the second front weft inlaid yarn is positioned on a second side of the hypothetical midline.

Clause 5. The warp knit component according to any of clauses 2 through 4, wherein the first front weft inlaid yarn is one or more of a different yarn type and a different denier than the second front weft inlaid yarn.

Clause 6. The warp knit component according to any of clauses 1 through 5, further comprising a first back weft inlaid yarn that extends through every successive loop in the first warp knit course and a second back weft inlaid yarn that extends through every successive loop in the second warp knit course, the first back weft inlaid yarn and the second back weft inlaid yarn positioned on a technical back of the warp knit component.

Clause 7. The warp knit component according to clause 6, further comprising one more intervening warp knit courses between the first warp knit course and the second warp knit course.

Clause 8. The warp knit component according to clause 7, further comprising one or more additional back weft inlaid yarns that extend through every successive loop in the one or more intervening warp knit courses.

Clause 9. An integrally warp knit upper having a medial side and a lateral side, the integrally warp knit upper comprising: a plurality of warp knit courses that extend from the medial side to the lateral side of the upper; and a first front weft inlaid yarn positioned on the lateral side of the upper, wherein: the first front weft inlaid yarn extends through at least one loop in a first warp knit course of the plurality of warp knit courses, after extending through the at least one loop in the first warp knit course, the first front weft inlaid yarn extends as a float positioned on an outer-facing surface of the integrally warp knit upper, and after extending as the float, the first front weft inlaid yarn extends through at least one loop in a second warp knit course of the plurality of warp knit courses, the second warp knit course offset in a material flow direction from the first warp knit course.

Clause 10. The integrally warp knit upper according to clause 9, further comprising a second front weft inlaid yarn positioned on the medial side of the upper, wherein: the second front weft inlaid yarn extends through at least one loop in a third warp knit course of the plurality of warp knit courses, after extending through the at least one loop in the third warp knit course, the second front weft inlaid yarn extends as a float positioned on the outer-facing surface of the integrally warp knit upper, and after extending as the float, the second front weft inlaid yarn extends through at least one loop in a fourth warp knit course.

Clause 11. The integrally warp knit upper according to clause 10, wherein the first front weft inlaid yarn is one or more of a different yarn type and a different denier than the second front weft inlaid yarn.

Clause 12. The integrally warp knit upper according to any of clauses 10 through 11, wherein the first front weft inlaid yarn forms a first geometric pattern on the lateral side of the upper, wherein the second front weft inlaid yarn forms a second geometric pattern on the medial side of the upper, and wherein the first geometric pattern comprises a different geometric pattern than the second geometric pattern.

Clause 13. The integrally warp knit upper according to any of clauses 10 through 12, wherein at least one of the first warp knit course and the second warp knit course is offset from at least one of the third warp knit course and the fourth warp knit course in the wale-wise direction.

Clause 14. The integrally warp knit upper according to any of clauses 9 through 13, wherein the first front weft inlaid yarn forms a loop at a throat area of the upper.

Clause 15. The integrally warp knit upper according to clause 14, further comprising a lace that extends through the loop.

Clause 16. The integrally warp knit upper according to any of clauses 9 through 15, further comprising a first back weft inlaid yarn that extends through every successive loop in the first warp knit course and a second back weft inlaid yarn that extends through every successive loop in the second warp knit course, the first back weft inlaid yarn and the second back weft inlaid yarn positioned on a technical back of the integrally warp knit upper.

Clause 17. A method of manufacturing a warp knit component, the method comprising: knitting a plurality of warp knit courses that form a plurality of warp knit wales that extend in a material flow direction; using a first front weft inlay feeder: inlaying a first front weft inlaid yarn in a first warp knit course of the plurality of warp knit courses such that the first front weft inlaid yarn extends through at least one loop in the first warp knit course, floating the first front weft inlaid yarn over a technical face of the warp knit component as the first front weft inlay feeder advances in the material flow direction, and inlaying the first front weft inlaid yarn in a second warp knit course of the plurality of warp knit courses such that the first front weft inlaid yarn extends through at least one loop in the second warp knit course.

Clause 18. The method of manufacturing the warp knit component according to clause 17, further comprising: using a second front weft inlay feeder: inlaying a second front weft inlaid yarn in a third warp knit course of the plurality of warp knit courses such that the second front weft inlaid yarn extends through at least one loop in the third warp knit course, floating the second front weft inlaid yarn over the technical face of the warp knit component as the second front weft inlay feeder advances in the material flow direction, and inlaying the second front weft inlaid yarn in a fourth warp knit course of the plurality of warp knit courses such that the second front weft inlaid yarn extends through at least one loop in the fourth warp knit course.

Clause 19. The method of manufacturing the warp knit component according to clause 18, wherein the first front weft inlaid yarn is positioned on a first side of a hypothetical midline that extends in the material flow direction, and wherein the second front weft inlaid yarn is positioned on a second side of the hypothetical midline.

Clause 20. The method of manufacturing the warp knit component according to any of clauses 18 through 19, wherein the first front weft inlaid yarn is one or more of a different yarn type and a different denier than the second front weft inlaid yarn.

Aspects of the present disclosure have been described with the intent to be illustrative rather than restrictive.

Alternative aspects will become apparent to those skilled in the art that do not depart from its scope. A skilled artisan may develop alternative means of implementing the aforementioned improvements without departing from the scope of the present disclosure.

It will be understood that certain features and sub-combinations are of utility and may be employed without reference to other features and sub-combinations and are contemplated within the scope of the claims. Not all steps listed in the various figures need be carried out in the specific order described.

What is claimed is:

1. An integrally warp knit upper for an article of footwear, the integrally warp knit upper comprising:

a medial side and a lateral side;

a plurality of warp knit courses that extend from the medial side to the lateral side;

a first front weft inlaid yarn positioned on the lateral side of the upper, wherein:

the first front weft inlaid yarn extends through at least one loop in a first warp knit course of the plurality of warp knit courses in a course-wise direction, after extending through the at least one loop in the first warp knit course, the first front weft inlaid yarn extends as a float positioned on an outer-facing surface of the integrally warp knit upper in a direction oblique to the course-wise direction, and after extending as the float, the first front weft inlaid yarn extends through at least one loop in a second warp knit course of the plurality of warp knit courses in the course-wise direction, the second warp knit course offset in a material flow direction from the first warp knit course, wherein the first front weft inlaid yarn forms a lace loop in a throat area of the upper; and a lace that extends through the lace loop.

2. The integrally warp knit upper of claim 1, further comprising a second front weft inlaid yarn positioned on the medial side of the upper, wherein:

the second front weft inlaid yarn extends through at least one loop in a third warp knit course of the plurality of warp knit courses, after extending through the at least one loop in the third warp knit course, the second front weft inlaid yarn extends as a float positioned on the outer-facing surface of the integrally warp knit upper, and after extending as the float, the second front weft inlaid yarn extends through at least one loop in a fourth warp knit course.

3. The integrally warp knit upper of claim 2, wherein the first front weft inlaid yarn is one or more of a different yarn type and a different denier than the second front weft inlaid yarn.

4. The integrally warp knit upper of claim 2, wherein the first front weft inlaid yarn forms a first geometric pattern on the lateral side of the upper, wherein the second front weft inlaid yarn forms a second geometric pattern on the medial side of the upper, and wherein the first geometric pattern comprises a different geometric pattern than the second geometric pattern.

5. The integrally warp knit upper of claim 2, wherein at least one of the first warp knit course and the second warp knit course is offset from at least one of the third warp knit course and the fourth warp knit course in a wale-wise direction.

6. The integrally warp knit upper of claim 1, further comprising a first back weft inlaid yarn that extends through every successive loop in the first warp knit course and a second back weft inlaid yarn that extends through every successive loop in the second warp knit course, the first back weft inlaid yarn and the second back weft inlaid yarn positioned on a technical back of the integrally warp knit upper.

7. An integrally warp knit upper for an article of footwear, the integrally warp knit upper comprising:

a medial side and a lateral side;

a plurality of warp knit courses that extend from the medial side to the lateral side, wherein at least some loops in adjacent courses of the plurality of warp knit courses interlock with each other;

a first front weft inlaid yarn positioned on the lateral side of the upper;

a second front weft inlaid yarn positioned on the medial side of the upper, wherein:

the first front weft inlaid yarn extends through at least one loop in a first warp knit course of the plurality of warp knit courses, after extending through the at least one loop in the first warp knit course, the first front weft inlaid yarn extends as a float positioned on an outer-facing surface of the integrally warp knit upper, and after extending as the float, the first front weft inlaid yarn extends through at least one loop in a second warp knit course of the plurality of warp knit courses, the second warp knit course offset in a material flow direction from the first warp knit course, the second front weft inlaid yarn extends through at least one loop in a third warp knit course of the plurality of warp knit courses, after extending through the at least one loop in the third warp knit course, the second front weft inlaid yarn extends as a float positioned on the outer-facing surface of the integrally warp knit upper, after extending as the float, the second front weft inlaid yarn extends through at least one loop in a fourth warp knit course, at least one of the first warp knit course and the second warp knit course is offset from at least one of the third warp knit course and the fourth warp knit course in a wale-wise direction, wherein the first front weft inlaid yarn forms a lace loop in a throat area of the upper; and a lace that extends through the lace loop.

8. An article of footwear comprising an integrally warp knit upper, the integrally warp knit upper comprising:

a medial side and a lateral side;

a plurality of warp knit courses that extend from the medial side to the lateral side, wherein at least some loops in adjacent courses of the plurality of warp knit courses interlock with each other;

a first front weft inlaid yarn positioned on the lateral side of the upper; wherein:

the first front weft inlaid yarn extends through at least one loop in a first warp knit course of the plurality of warp knit courses, after extending through the at least one loop in the first warp knit course, the first front weft inlaid yarn extends as a float positioned on an outer-facing surface of the integrally warp knit upper, after extending as the float, the first front weft inlaid yarn extends through at least one loop in a second warp knit course of the plurality of warp knit courses, the second warp knit course offset in a material flow direction from the first warp knit course;

the integrally warp knit upper further comprises a first back weft inlaid yarn that extends through every successive loop in the first warp knit course and a second back weft inlaid yarn that extends through every successive loop in the second warp knit course, the first back weft inlaid yarn and the second back weft inlaid yarn positioned on a technical back of the integrally warp knit upper;

the article of footwear further comprises a sole structure secured to the integrally warp knit upper, wherein the first front weft inlaid yarn forms a lace loop in a throat area of the upper; and a lace that extends through the lace loop.

* * * * *